US005443006A

United States Patent [19]

Beisel et al.

[11] Patent Number: 5,443,006

[45] Date of Patent: Aug. 22, 1995

[54] PROCESS AND DEVICE FOR CARRYING AWAY PRINTING PLATES FROM A PRINTING MACHINE

[75] Inventors: Hermann Beisel, Walldorf; Peter T. Blaser, Dielheim; Dieter Hauck, Eberbach; Rudolf Hutzenlaub, Mannheim; Helmut Jäger, Königsbach-Stein; Hans-Georg Jahn, Wiesenbach; Robert Müller, Mörlenbach; Anton Rodi, Leimen; Nikolaus Spiegel, Walldorf, all of Germany

[73] Assignee: Heidelberger Druckmaschinen AG, Heidelberg, Germany

[21] Appl. No.: 211,097

[22] PCT Filed: Sep. 7, 1992

[86] PCT No.: PCT/EP92/02056

§ 371 Date: May 12, 1994

§ 102(e) Date: May 12, 1994

[87] PCT Pub. No.: WO93/04863

PCT Pub. Date: Mar. 18, 1993

[30] Foreign Application Priority Data

Sep. 12, 1991 [DE] Germany ..... 41 30 359.8

[51] Int. Cl.[6] ..... B41F 1/28

[52] U.S. Cl. ..... 101/477; 101/415.1

[58] Field of Search ..... 101/477, 415.1, 378, 101/132

[56] References Cited

U.S. PATENT DOCUMENTS

| | | | |
|---|---|---|---|
| 4,727,807 | 3/1988 | Suzuki et al. | 101/415.1 |
| 5,094,165 | 3/1992 | Sugiyama et al. | 101/415.1 |
| 5,111,744 | 5/1992 | Wieland | 101/415.1 |
| 5,127,328 | 7/1992 | Wieland | 101/415.1 |
| 5,218,907 | 6/1993 | Komori et al. | 101/415.1 |
| 5,224,423 | 7/1993 | Borel | 101/415.1 |

FOREIGN PATENT DOCUMENTS

| | | |
|---|---|---|
| 0432660 | 6/1991 | European Pat. Off. . |
| 0435410 | 7/1991 | European Pat. Off. . |

*Primary Examiner*—Eugene H. Eickholt

*Attorney, Agent, or Firm*—Herbert L. Lerner; Laurence A. Greenberg

[57] ABSTRACT

A device in the form a magazine is disclosed for carrying away used printing plates from the plate cylinder of a printing machine. The device applies in particular to the automatic exchange of printing plates. The device has an arrangement for carrying away the plates with (first) holders for each printing plate capable of being activated. The (first) holders are arranged on a (first) carriage that can be moved along a (first) guide substantially over the whole length of the device, inside the magazine.

16 Claims, 10 Drawing Sheets

Fig. 7
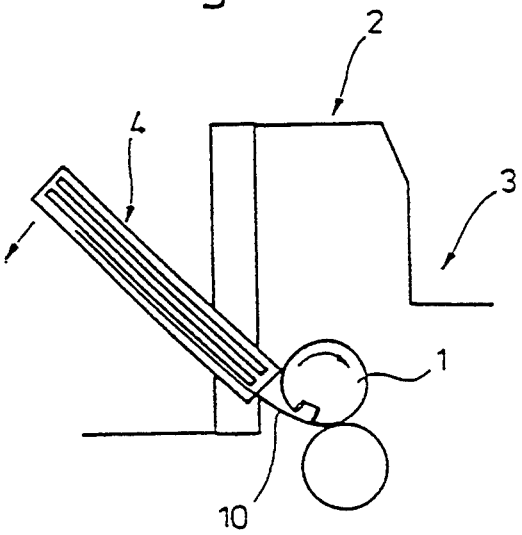
Fig. 8
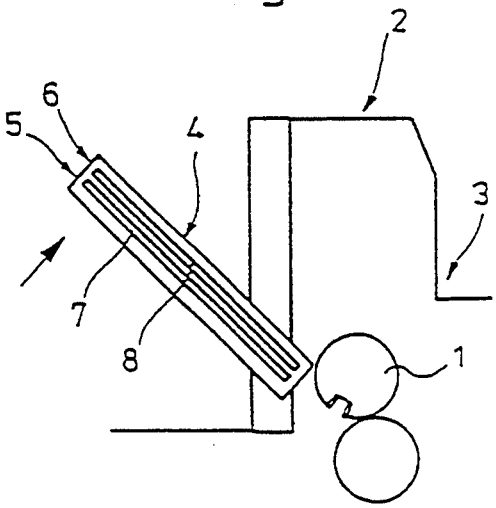
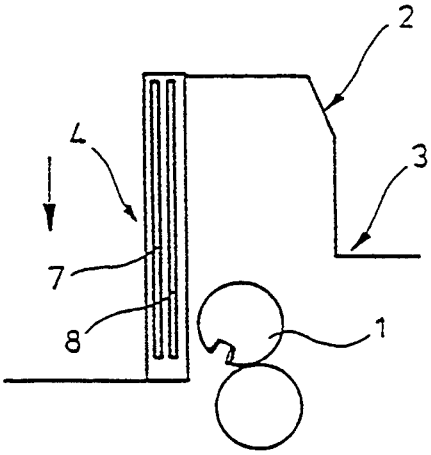
Fig. 9

PROCESS AND DEVICE FOR CARRYING AWAY PRINTING PLATES FROM A PRINTING MACHINE

The invention relates to a device, in the form of a magazine, for removing printing plates from a plate cylinder of a printing press, in particular for the automatic or semi-automatic changing of printing plates, with a plate-removing apparatus, said apparatus comprising activatable (first) holding means for the respective printing plate.

A device of the initially mentioned kind is known from European patent application 0 435 410. The purpose of said device is to automate the changing of printing plates. The magazine holds old, used plates. For removal, the used printing plate is released from the plate cylinder at one end and is then—through appropriate rotation of the plate cylinder—partially inserted into the magazine. Subsequently, the other end of the printing plate is released by the tensioning device of the plate cylinder and the entire printing plate is introduced into the magazine with the plate-removing apparatus. Subsequently, a new printing plate to be used is taken from the magazine by means of the plate-supplying apparatus. First, one end of the printing plate is inserted into the corresponding clamping device of the plate cylinder, where it is clamped, and then"through rotation of the plate cylinder"the printing plate is removed completely from the magazine and is drawn around the outer cylindrical surface of the plate cylinder. Then, the other end of the printing plate is clamped and the plate is tensioned in the circumferential direction. The plate-removing apparatus of the known device comprises suction pads which are adapted to be moved by means of a piston/cylinder unit. Since the cylinder of the piston/cylinder unit is of a length identical to that of the piston rod and its longitudinal extent adjoins the motion path of the piston, this necessitates a correspondingly long design of the magazine.

The object of the invention is to create a device of the initially mentioned kind, said device permitting the removal of printing plates while being of simple construction, reliable operation and small design.

The object of the invention is achieved in that the (first) holding means are disposed on a first carriage, said carriage being adapted to be moved along a first guide more or less over the whole length of the device, inside the magazine. The fact that the first carriage is adapted to be moved more or less over the whole length of the device inside the magazine means that old, used printing plates can be introduced completely into the cassette of the magazine in one operation. This would not be possible by means of a conventional piston/cylinder unit, because the latter itself is of a certain length and said length is not available for the displacement travel.

The first holding means are preferably in the form of activatable first suction elements.

It is particularly advantageous if the first carriage is adapted to be moved by means of a driving apparatus, said driving apparatus comprising a magnetic coupling. The magnetic coupling represents not a rigid, but a flexible coupling and, moreover, it is possible therewith to move the first carriage over the whole length of the device.

In particular, it is provided that the driving apparatus comprises a non-ferromagnetic tube, said tube extending along the motion path of the first carriage and being longitudinally displaceably surrounded by a ferromagnetic component attached to the carriage, particularly a steel ring, with a magnetic piston, longitudinally movable by a pressure medium, being disposed in the tube, said piston forming the magnetic coupling together with the ferromagnetic component. If, therefore, the magnetic piston is displaced in desired manner in the tube through the pressure medium, the ferromagnetic component and-thus the first carriage are moved along their guide. The guide consists preferably of two spaced-apart guide parts, particularly guide rods. Said guide parts extend preferably parallel to one another. The two guides are disposed in the side regions of the magazine. The driving apparatus is situated preferably between the two guide parts.

Alternatively, however, it is also possible for one of the guide parts to be formed by the driving apparatus. Consequently, a corresponding guide rod is situated on one side of the magazine and the tube, provided with magnetic piston, is situated on the other side, with the ferromagnetic component, particularly the steel ring, being longitudinally displaceably held on the tube and, to that extent, likewise forming a guide.

As already mentioned, the first holding means are activatable (the same applies also to the second holding means mentioned hereinbelow); that is, they can be switched on and off in their function, namely that of holding or not holding the printing plates. Furthermore, however, activation also comprises the possibility of the holding means being moved transversely with respect to the plane of the printing plates, so that they can come up against the surface of the corresponding printing plate. Preferably, as mentioned hereinbefore, the holding means are in the form of suction elements; that is, they comprise suction pads which operate by means of a connectable vacuum.

Moreover, in addition to the possibility of all holding means being displaceable in the direction transverse to the plane of the printing plates, at least one of the first holding means is itself held on the first carriage in such a manner as to be movable transversely with respect to the plane of the printing plates. Consequently, the first holding means can not only be lengthened or shortened in the longitudinal direction towards the adjacent printing plate, but can in general be additionally moved in said direction. This is accomplished, with the carriage in an upper position, by means of a forced-control device in such a manner that, on insertion into the cassette, the preferably angled printing-plate rear edge of the used printing plate comes under a holding edge of the cassette. When a used printing plate is being removed, as soon as the rear edge thereof has been released by the rear-edge clamping device of the plate cylinder and, through backward rotation of the plate cylinder, the printing plate has been partially inserted into the interior of the magazine, the printing-plate rear end is gripped by the first holding means. The carriage is in a lower position. In order to introduce the used printing plate into the interior of the magazine, the carriage is then moved into the aforementioned upper position, with, at the same time, the plate cylinder performing a backward rotation and the printing plate thus being "unwound" from the outer cylindrical surface of the plate cylinder. When the carriage is moved into the upper position, the forced-control device then comes into operation, moving the aforementioned first holding means and thus the rear-edge end region of the printing plate towards the cassette holding the used printing plate, with the result that the angled rear edge of the printing plate comes under the aforementioned holding edge of the cassette.

Preferably, the forced-control device is formed by a bevelled section which is contacted by a sensing member for moving, particularly for swiveling, the movably held first holding means.

When the rear edge of the printing plate has been moved into the depicted position, the printing-plate front end is engaged by at least one holder-down disposed in the lower region of the magazine and is thereby pressed likewise into the cassette. The holder-down remains in said position while the holding means slide the printing plate downwards by a fraction, with the result that the printing-plate front edge, too, comes under a holding edge of the cassette. Consequently, the printing plate to be removed is completely and reliably held in the cassette.

According to a further development of the invention, it is provided that disposed in the lower end of the magazine is at least one guide roller for introduction of the used printing plate into the cassette. Said guide roller makes it easier for the old, used printing plates to be supplied to the cassette of the magazine.

The invention is illustrated on the basis of a specimen embodiment with respect to the drawings, in which:

FIG. 7 shows the magazine in the plate-changing position during acceptance of the used printing plate;

FIG. 8 shows a representation according to FIG. 7, with, however, the printing plate already being completely in a cassette of the magazine;

FIG. 9 shows the magazine once again in the starting position;

Figure 1:
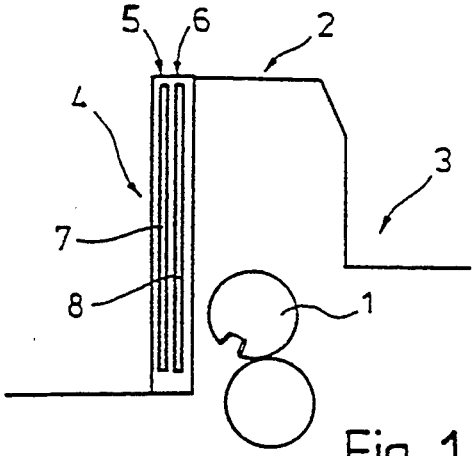
FIG. 1 shows a printing unit of a printing press in a schematic representation with a magazine in the starting position.

In order to provide for automatic or semi-automatic changing of printing plates—that is, to remove an old, used printing plate and then to supply a new printing plate to be used to the plate cylinder 1 of a printing unit 2 of a printing press 3—the printing unit 2 comprises a device in the form of a magazine 4. The magazine 4, which, in the case of a printing press 3 with a plurality of printing units 2, is provided on each printing unit 2 of the printing press 3, may also be used merely to supply a new printing plate to be used or merely to remove an already used printing plate (FIG. 1 to 9).

In FIG. 1, the magazine 4 is in its starting position (vertical position). In this idle position, the magazine 4 is secured (locked) against tilting. Normal printing-press operation (printing mode) is possible only with the magazine 4 in this lower, vertical position.

The magazine 4 comprises two holding shafts 5 and 6, into which cassettes 7 and 8, respectively, are insertable from above (FIG. 1). The cassette 7 is used to hold old printing plates which have already been used in the printing press 3. The cassette 7 is of such design that it is capable of holding a plurality of, for example five, used printing plates. Said printing plates form a printing-plate pile inside the cassette 7; that is, the individual printing plates are in flat contact with one another. The cassette 8 is used to hold new printing plates that are yet to be used. It, too, is capable of holding a plurality of, particularly five, printing plates simultaneously, with, once again, said printing plates being in flat association with one another. In order to remove the used printing plates, it is thus merely necessary to withdraw the cassette 7 out of the holding shaft 5. Once outside of the printing press 3, the cassette 8 can be furnished with new printing plates yet to be used. Once this has been done, the cassette 8 is inserted into the holding shaft 6 of the magazine 4, with the result that it is available for supplying the plate cylinder 1 of the corresponding printing unit 2.

Figure 2:
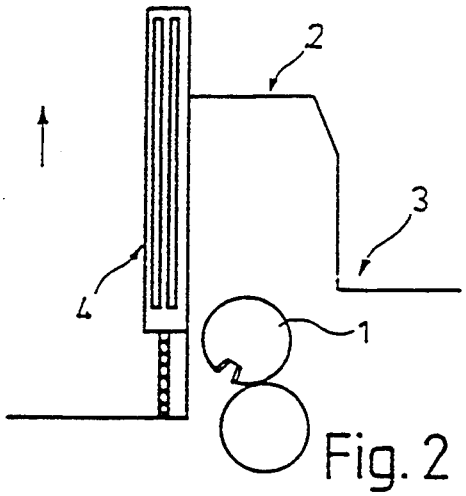
FIG. 2 shows the magazine from FIG. 1 in a centre position.
Figure 3:
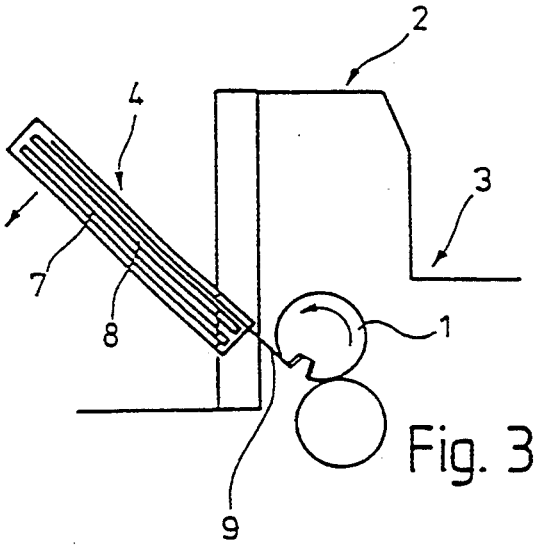
FIG. 3 shows the magazine in the plate-changing position while a new printing plate to be used is supplied to the plate cylinder of the printing press.
Figure 4:
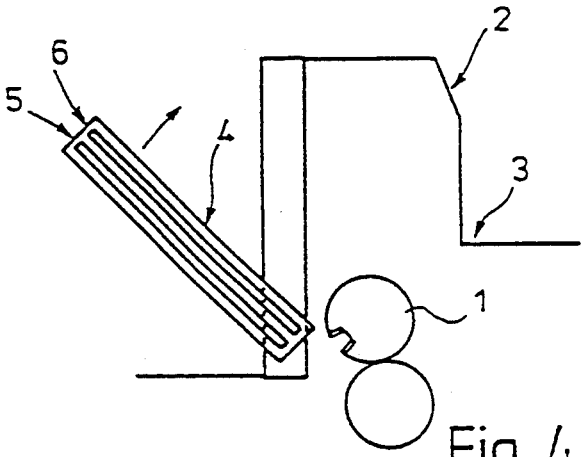
FIG. 4 shows a representation according to FIG. 3, with, however, the printing plate already having been clamped onto the plate cylinder.
Figure 5:
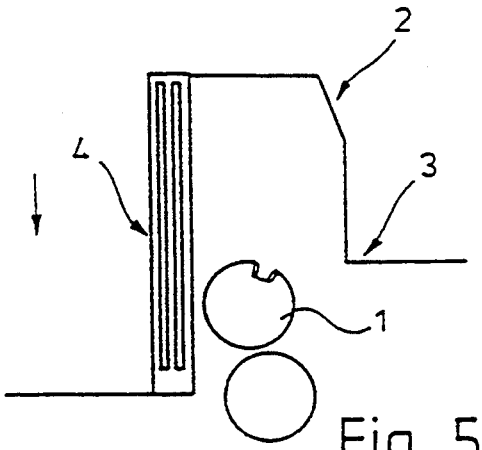
FIG. 5 shows the return of the magazine into the starting position.

Described hereinbelow are the individual positions of the magazine 4 which are assumed for the removal and/or supply of printing plates. If the plate cylinder 1 is to be supplied with a new printing plate 9, the magazine 4 moves—as shown in FIG. 2—vertically upwards into a centre position and then—as shown in FIG. 3—swivels into an oblique position (approximately 45°, for example). By means of a plate-supplying apparatus (still to be described in greater detail) of the magazine 4, the printing plate 9 to be used is then supplied to the plate cylinder 1 and is clamped thereon (FIG. 4). Subsequently, the magazine 1 then swivels back into its vertical position and is then lowered again into the lower position (starting position) as shown in FIG. 5.

Figure 6:
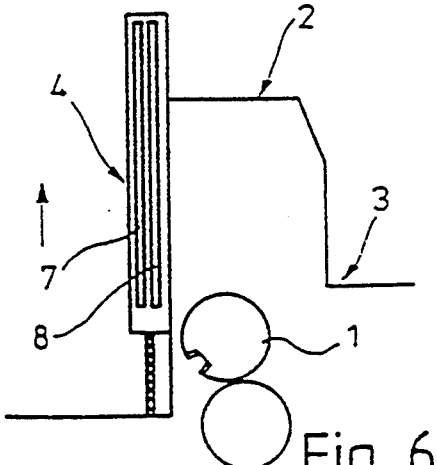
FIG. 6 shows the movement to-the centre position in order to accept a used printing plate.

The printing process can now be carried out. When the printing job has been performed, the printing plate 9 must be removed from the plate cylinder 1. For this purpose, a lifting device, in turn, lifts the magazine 4 into the centre position (FIG. 6). Subsequently, as shown in FIG. 7, the magazine 4 is swiveled into the oblique position and—through releasing of the plate rear edge and backward rotation of the plate cylinder 1—the used printing plate 10 is partially inserted into the magazine 4 (FIG. 7). As shown in FIG. 8, the used printing plate 10 is then pulled completely into the cassette 7 by a plate-removing apparatus (still to be described in greater detail) of the magazine 4. Next, the magazine 4 is again swiveled into its vertical position and then—as shown in FIG. 9—is lowered into the starting position.

Of course, it is also possible to combine the removal and supply of printing plates in order to effect the changing of printing plates. This means that, in the oblique position, a used printing plate 10 is first accepted by the magazine 4 and a new printing plate is then supplied to the plate cylinder 1. Once this has been done, the magazine 4 swivels back into the vertical and is lowered into the starting position.

Hereinbelow, the design of the magazine 4 is to be described in greater detail with reference to FIG. 10 to 12.

Figure 10:
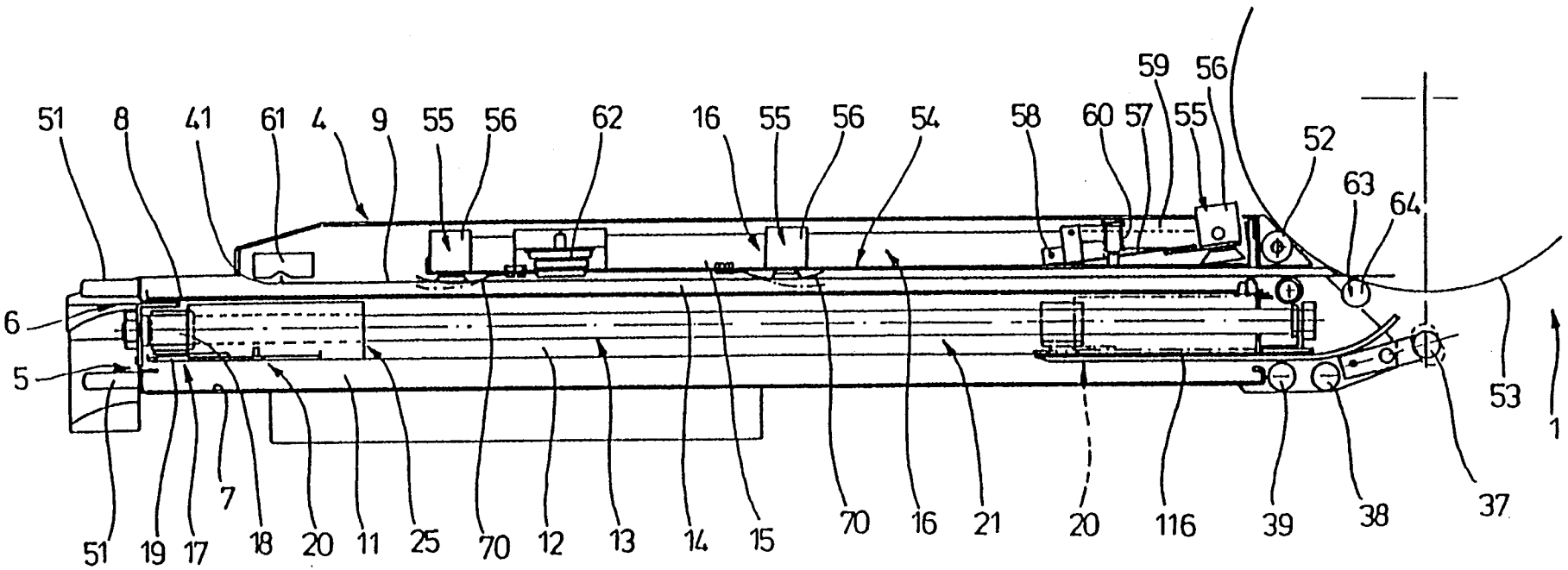
FIG. 10 shows a longitudinal section through the magazine.
Figure 11:
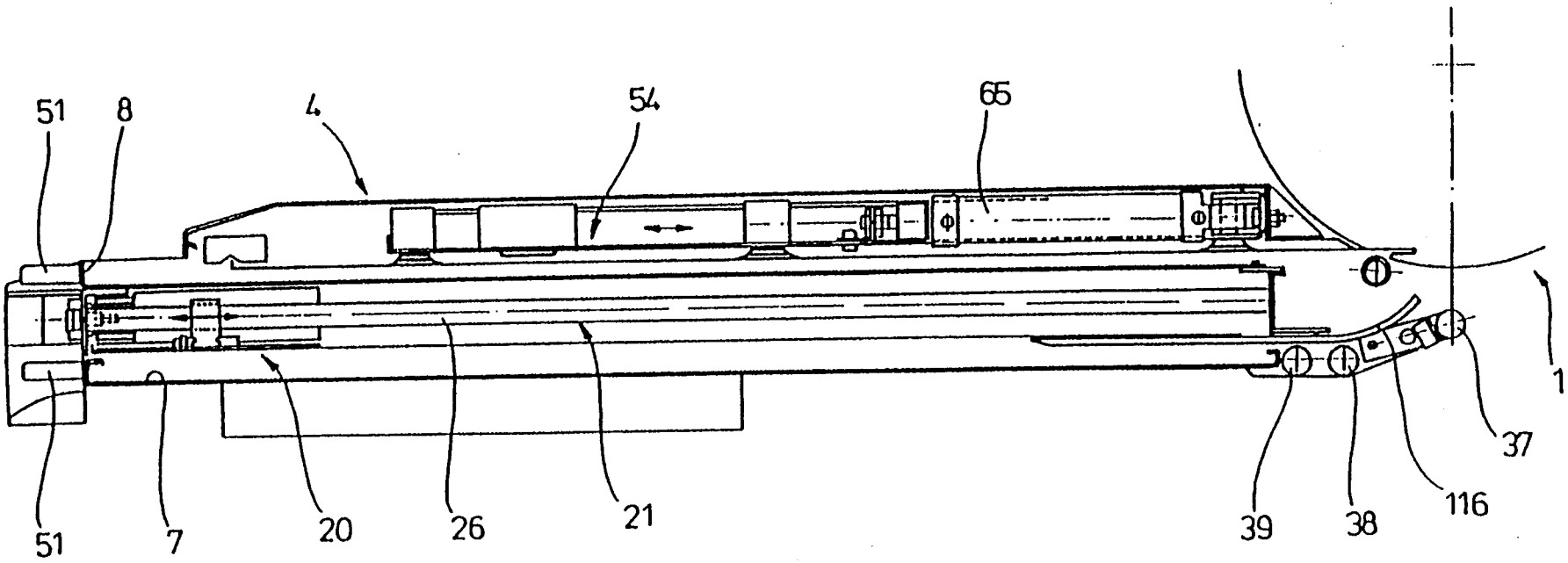
FIG. 11 shows a longitudinal section through the magazine according to FIG. 10, but in a different plane.
Figure 12:
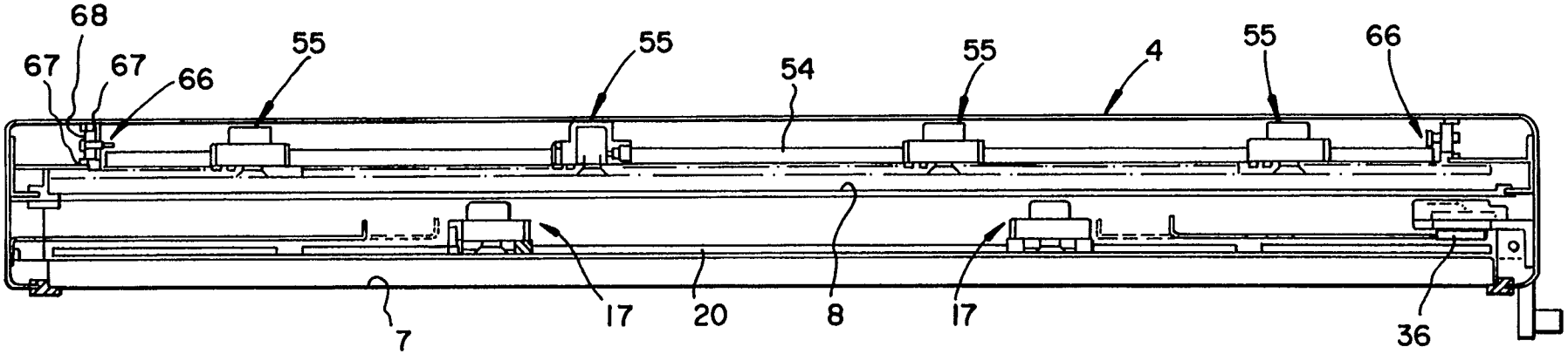
FIG. 12 shows a cross section through the magazine.

For graphical reasons, the magazine 4 is shown in FIG. 10 and 11 in a horizontal position in relation to the side edges of the drawing sheet. It should, however, be pointed out that the positions shown in FIG. 10 and 11 correspond to the oblique positions shown in FIG. 3, 4, 7 and 8.

The magazine 4 is of layered construction. It comprises an outer layer 11, which holds the cassette 7. Accommodated in a following layer 12 is a plate-removing apparatus 13, which is associated with the aforementioned cassette 7. The cassette 8 is disposed in a following layer 14. A further following layer 15 holds a plate-supplying apparatus 16, which cooperates with the printing plates 9 of the cassette 8.

Figure 17:
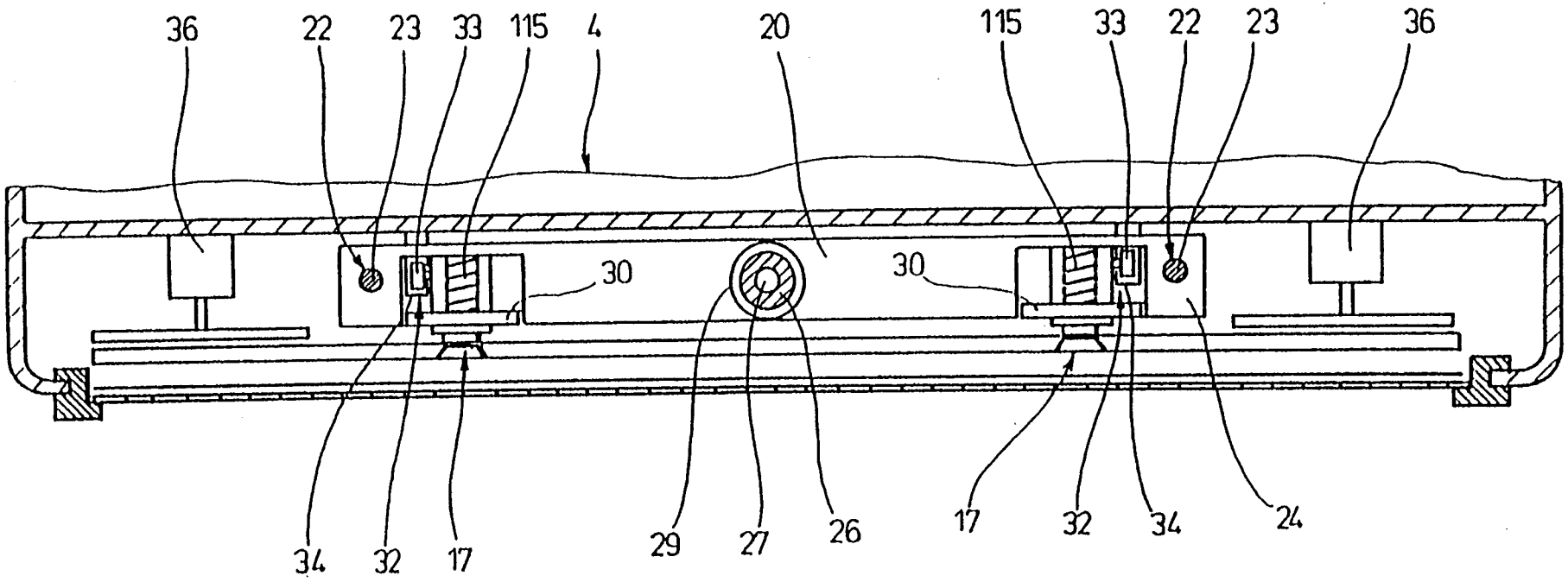
FIG. 17 shows a cross section through the magazine in the region of a plate-removing apparatus.

The plate-removing apparatus 13 comprises first holding means 17, which are in the form of activatable first suction elements 18. The suction pads 19 of the first suction elements 18 can be extended towards the printing plates 10 (for the sake of clarity, only one printing plate 9/10 is shown in each of FIG. 10 and 11). The first suction elements 18 are disposed on a first carriage 20, which is adapted to be moved along a first guide 21. As shown in FIG. 17, the guide 21 comprises two spaced-apart, parallel-extending guide parts 22, which are in the form of guide rods 23. The guide rods 23 are encompassed with little play by guide parts 24 of the first carriage 20.

The first carriage 20 is adapted to be moved along the first guide 21 by means of a driving apparatus 25. The driving apparatus 25 comprises a fixed, non-ferromagnetic tube 26 (an aluminium tube, for example), which extends from the top side to the bottom side of the magazine 4. Situated inside the tube 26 is a magnetic piston 27, which is adapted to be moved backwards and forwards inside the tube 26 by means of a pressure medium in addition to being positionable in desired positions. Situated on the first carriage 20 is a ferromagnetic component 28 which is in the form of a steel ring 29. Consequently, a movement of the magnetic piston 27 has the effect that the steel ring 29 and therefore the carriage 20 are moved through the intermediary of the magnetic field. Such a design provides a flexible coupling and, moreover, the carriage is movable from a position at the extreme top in the magazine 4 (shown by solid lines in FIG. 10) into a position at the extreme bottom (shown by broken lines in FIG. 10).

As shown in FIG. 17, a suction element 18 is disposed on either side of the driving apparatus 25. Each suction element 18 is attached to a lever 30, which is adapted to be swiveled towards the printing plate 10 by means of a hinge 31. The position of the levers 30 is determined by a forced-control device 32 (see also FIG. 13), which is formed by a roller 33 connected to each lever 30, said roller 33 running in a location-fixed guide rail 34. Each guide rail 34 comprises in the upper region of the magazine 4 a bevelled section 35 (FIG. 13), with the result that, with the carriage 20 moving into an upper position, the rollers 33 contact the bevelled sections 35 and thereby swivel the levers 30 and thus the suction elements 18 towards the printing plate 10. Springs 115 serve to return the lever 30 and to make the rollers 33 contact the bevelled sections 35.

Disposed on opposite sides in the lower region of the magazine 4 are actuatable holders-down 36, which serve to engage the printing plate 10 in said region. Furthermore, guide rollers 37, 38 and 39 are disposed in the lower region of the magazine 4.

Figure 13:
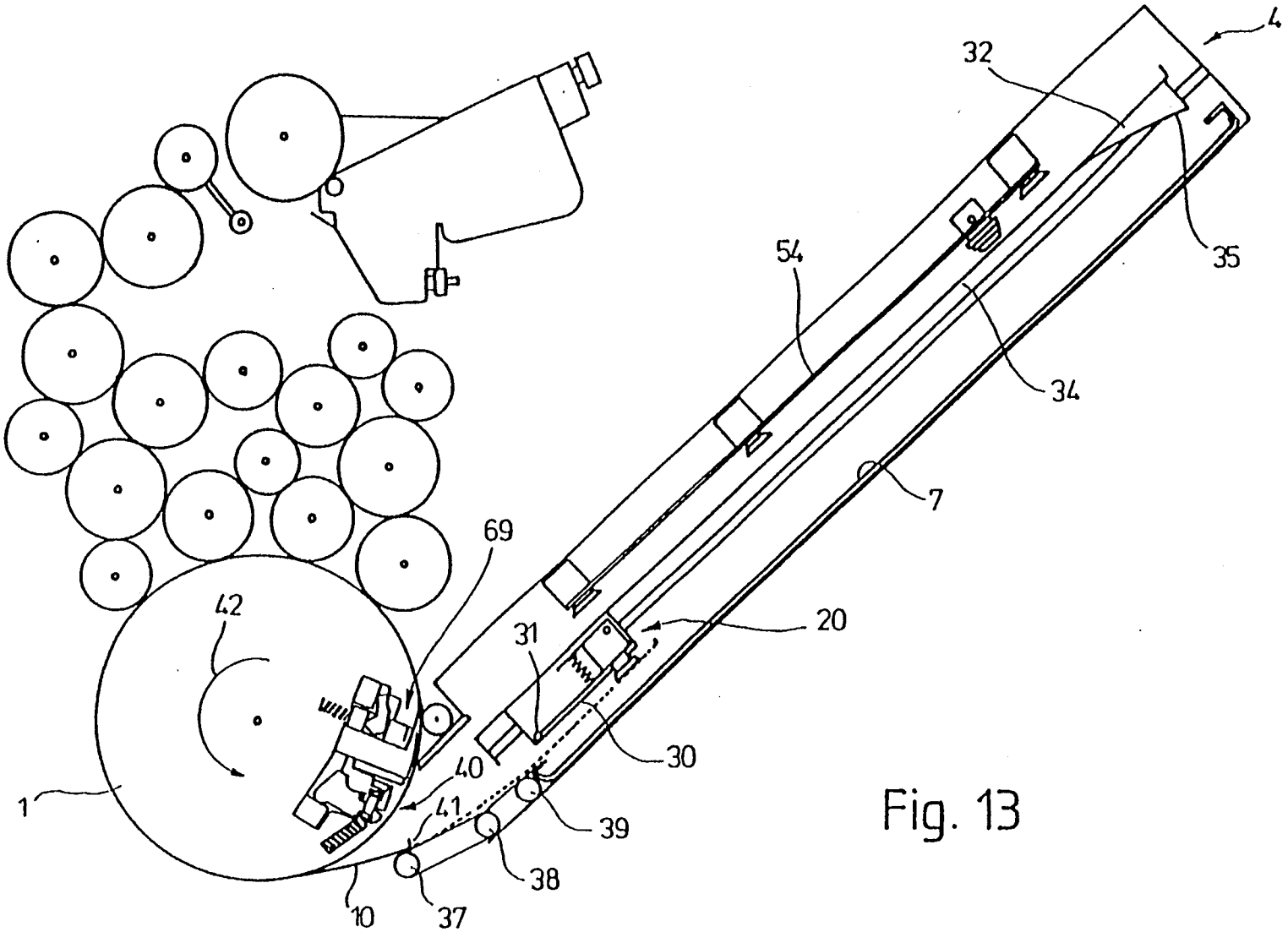
FIG. 13 shows a schematic view in the longitudinal section during the supply of a used printing plate to the magazine.
Figure 14:
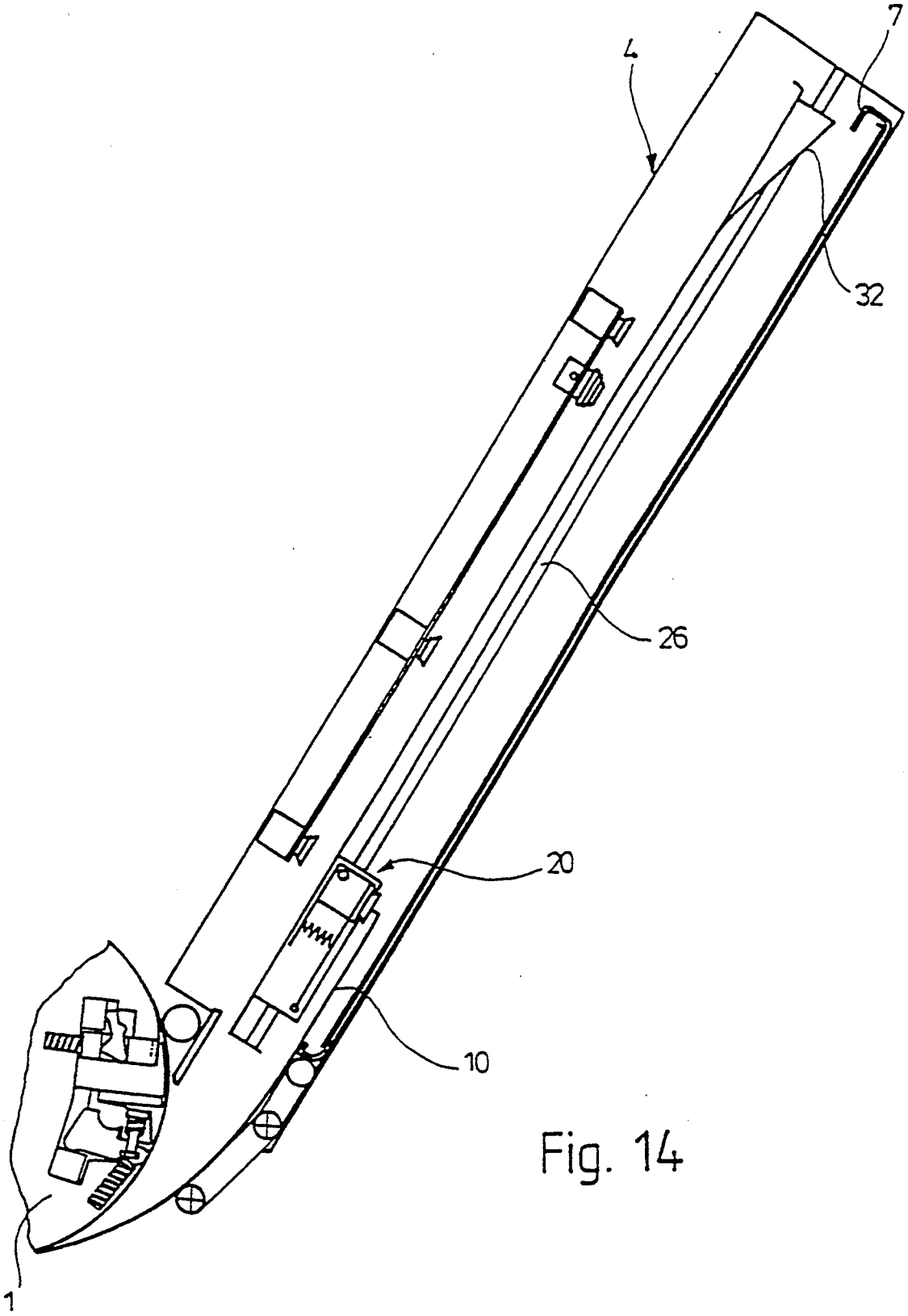
FIG. 14 shows a representation according to FIG. 13, but with the printing plate introduced further.
Figure 15:
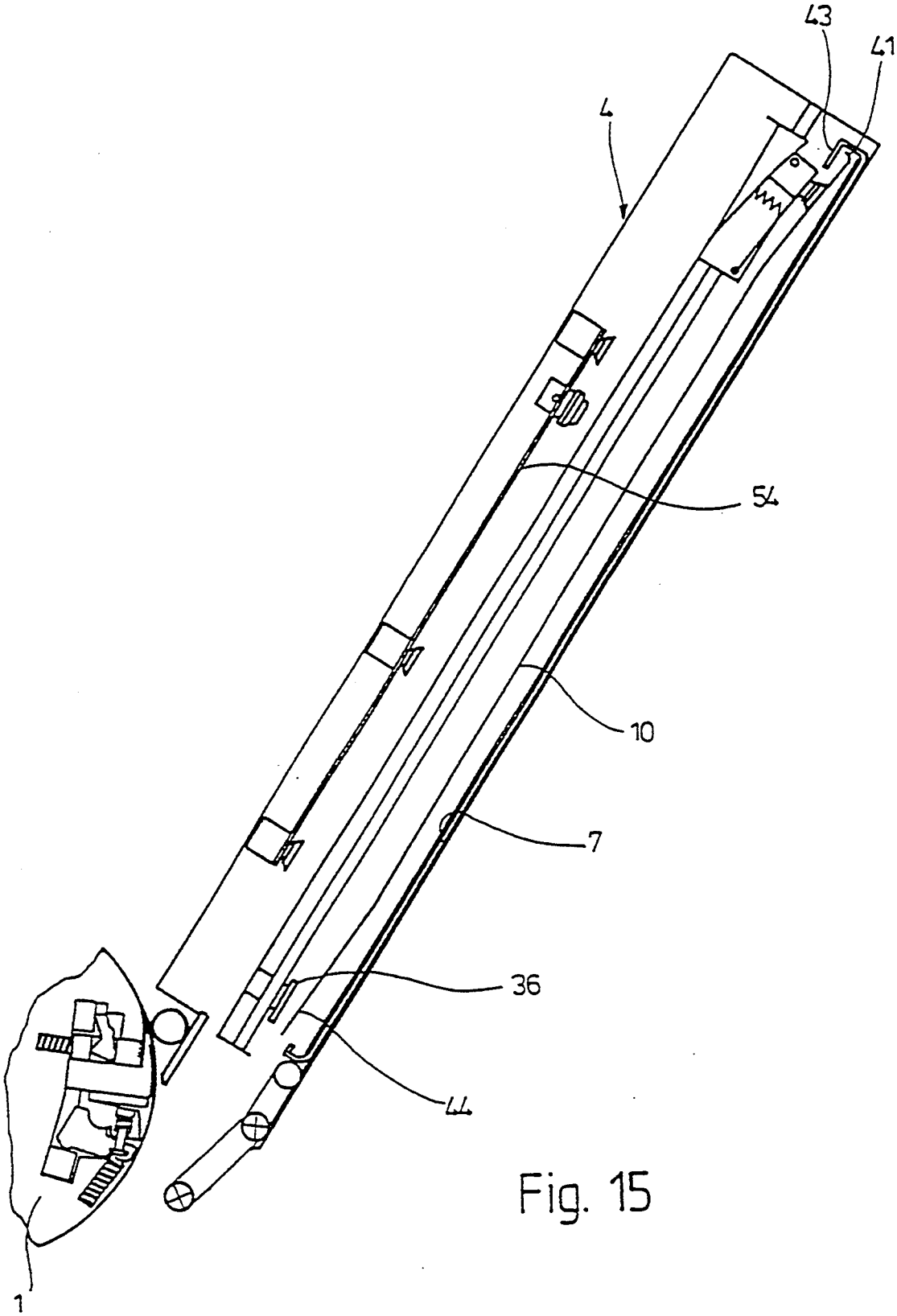
FIG. 15 shows the magazine in the longitudinal section with the printing plate completely introduced.
Figure 16:
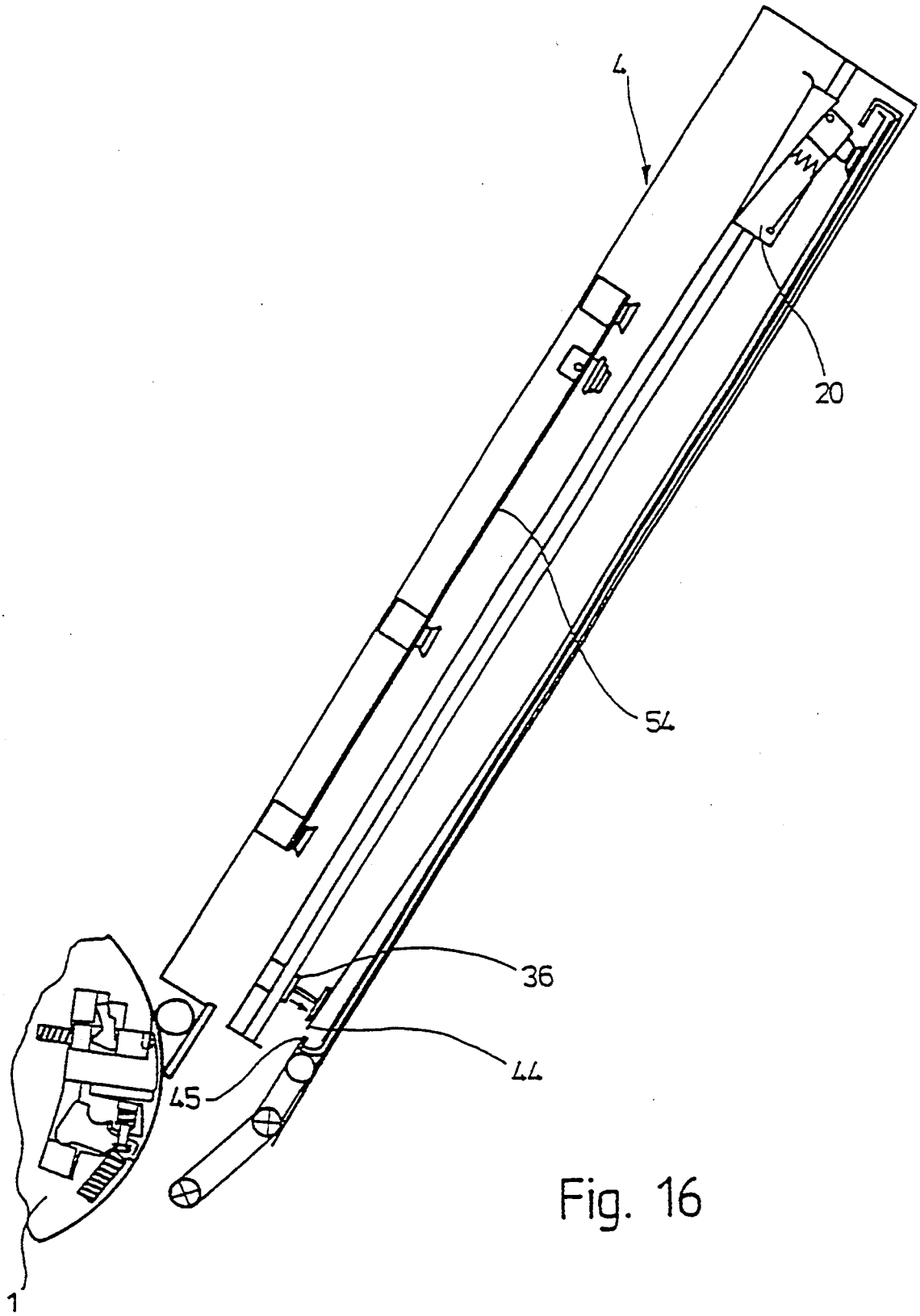
FIG. 16 shows a representation according to FIG. 15, but with the front edge of the printing plate being introduced into a cassette of the magazine.

Hereinbelow, there is a functional description of the removal of a used printing plate 10 from the plate cylinder 1 into the cassette 7 of the magazine 4. For this purpose, first of all, the magazine 4 is—as shown in FIG. 6 and 7—brought into the required oblique position. Subsequently, a rear-edge clamping device 40 of the plate cylinder 1 opens and releases the there-clamped, angled printing-plate rear edge 41. Owing to the inherent elasticity, the rear end of the printing plate 10 consequently strikes against the guide roller 37 (FIG. 13). Subsequently, through backward rotation (arrow 42) of the plate cylinder 1, the printing plate 10 is inserted into the cassette 7 of the magazine 4. The guide rollers 37, 38 and 39 assist with the introduction of the rear-edge end of the printing plate 10. Guide rails 116 may be provided, said guide rails 16 sliding in cutouts of the printing-plate rear edge 41. Said introduction is shown by a dotted line in FIG. 13 and by an unbroken line in FIG. 14. When approximately one-third of the printing plate 10 has been inserted into the magazine 4, the suction elements 18 of the carriage 20 (the carriage 20 being in the lowermost position inside the magazine 4) are activated; that is, the suction pads 19 move towards the printing plate 10 to be held and firmly adhere by suction to the printing plate 10. Next, with simultaneous further backward rotation of the plate cylinder 1, the carriage 20 moves into its upper position, as a result of which the printing plate 10 is pulled completely into the magazine 4, with the front edge 44 of the printing plate 10 also being unclamped. When the carriage 20 enters the upper end region of the magazine 4, the rollers 33 contact the bevelled sections 35 and swivel the levers 30, with the result that—as shown in FIG. 15—the angled printing-plate rear edge 41 comes under a holding edge 43 of the cassette 7. Subsequently, the holders-down 36 press down the printing plate 10 in the region of its front edge 44 (FIG. 16), with the result that the front edge 44 comes to lie at a lower position than a holding edge 45 of the cassette 7. Through the force of gravity and/or through movement of the carriage 20, the front edge 44 is then brought under the holding edge 45 through pulling-down of the printing plate 10. Consequently, the printing plate 10 is safely disposed in the cassette 7. Particularly if a plurality of already used printing plates 10 are to be accommodated in the cassette 7, it is necessary for the last-inserted printing plates 10 to be pulled down by means of the carriage 20 and to be held by the holders-down 36, so that they come under the holding edge 45, since, owing to relatively great stresses at the start of the printing plate, the force of gravity alone is no longer sufficient to move the printing plates 10 into said position.

The removal of the used printing plates 10 from the magazine 4 is accomplished in simple manner in that the cassette 7 is withdrawn from the associated holding shaft 5.

Reference may be made already at this point to a special feature of the cassette 8 containing the new printing plates 9 yet to be used, although the removal of the printing plates 9 from the cassette 8 will be discussed at a later point hereinbelow. If there is a plurality of printing plates 9 piled one on-top of the other inside the cassette 8, then it is possible, when the uppermost printing plate 9 is removed, for a vacuum to be formed with respect to the following printing plate 9. This may result in two printing plates being removed simultaneously by mistake owing to the fact that they "stick together". To prevent this, a special removal technique is implemented and will be discussed in greater detail hereinbelow; moreover, it is possible to provide spacers between the individual printing plates 9, with the result that the formation of a vacuum is prevented. The spacers are preferably in the form of plastic tabs. These can be clipped preferably into locking seats in the edge regions. Consequently, when a cassette 8 is being furnished with printing plates, spacers are first of all clipped in position before a further printing plate 9 is laid on a printing plate 9 already in the cassette 8. The spacers are so flexible that they yield when the printing plate below is removed. If, after the removal of a printing plate 10, a new, as yet unused printing plate 9 is to be clamped immediately onto the plate cylinder 1, then the magazine 4 remains in its oblique position and a new printing plate 9 is taken from the cassette 8. This is accomplished by means of the plate-supplying apparatus 16. In order for a printing plate 9 from the cassette 8 to be supplied to the plate cylinder 1 by means of the plate-supplying apparatus 16, the magazine 4 is—as mentioned hereinbefore—in its oblique position in which support rollers 52 are supported on cylinder bearers 53 associated with the plate cylinder 1. The plate-supplying apparatus 16 comprises on a second carriage 54 second holding means 55, which are likewise in the form of activatable suction elements 56 (second suction elements). As shown in FIG. 10 and 12, the suction elements are each disposed spaced-apart in rows in groups of four, with three rows being provided on the second carriage 54. It is also possible for the lower row of suction elements 56 nearest to the plate cylinder 1 to be equipped with four suction elements 56 and for the other rows each to be provided with three. The suction elements 56 disposed in the lower row associated with the plate cylinder 1 are attached to levers 57, which are adapted to be swiveled about shafts 58. Pneumatic cylinders 59 are provided for the actuation of the levers 57. Furthermore, the levers 57 are subjected to the force of a spring 60. Disposed in the upper region of the magazine 4 is a preferably optical sensor 61, which monitors the position of the associated printing plate 9, particularly the position of the rear edge 41 thereof. Disposed between the upper and middle rows of suction elements is an activatable pressing-down device 62 for engagement of the printing plates 9.

In addition, the magazine 4 comprises at its lower end a displaceable pressing-on element 63, which is in the form of a pressing-on roller 64 displaceable radially with respect to the plate cylinder 1.

The second carriage 54 is movable along a second guide 66 (FIG. 12) by means of a piston/cylinder unit 65. The second guide is formed by fixed profile rails 67, in which run guide rollers 68 of the carriage 54.

For the supplying of a printing plate 9, the lowermost suction elements 56, associated with the plate cylinder 1, may first of all come into operation, with the levers 57 being in their non-deflected positions. Thereafter, the suction elements 56 of the middle row of suckers and then the suction elements 56 of the upper row of suckers are activated. A different sequence, such as first the middle row and then the row at the edge, is conceivable. The non-simultaneous, but consecutive activation of the rows of suction elements ensures that the uppermost, new printing plate 9 is lifted in such a manner that no vacuum or only a very small vacuum is formed with respect to the further printing plate 9 below. This guarantees that only one printing plate 9 is lifted. As for the rest, the aforementioned spacers (plastic tabs) may be disposed between the individual printing plates 9, which additionally counteracts the formation of a vacuum. When the printing plate 9 has been lifted, the carriage 54 is pushed towards the plate cylinder 1 by means of the piston/cylinder unit 65. The front edge 44 of the printing plate 9 enters the front-edge clamping device 69 of the plate cylinder 1, which was appropriately positioned beforehand. During the above-depicted advance of the carriage 54, the angled printing-plate rear edge 41 slides through under the sensor 61, which registers the correct transport of the printing plate 9. During the transport of the carriage 54, a bypass in the air supply to the suckers of the suction elements 56 is activated, since a strong suction air is required only for the suction-gripping of the printing plate 9. After the carriage 54 has almost reached its outermost position facing the plate cylinder 1, the suckers of the lowermost and middle rows of suction elements 56 are rendered pressureless or are provided only with a weak vacuum; the printing plate 9 is therefore held only by the uppermost row of suckers. The purpose of this is so that the printing plate 9 can be better aligned. Subsequently, the front-edge clamping device 69 is closed, with the result that the front edge 44 of the printing plate 9 is firmly clamped. Next, the plate cylinder 1 rotates in the forward direction, pulling the printing plate 9 onto its outer cylindrical surface. Thanks to the bypass, the suction elements are provided only with a weak vacuum, with the result that they still hold the printing plate, but the printing plate can still be displaced on the suction elements through the rotation of the plate cylinder. Before the printing-plate rear edge passes the two upper rows of suckers, the latter are rendered pressureless and brackets 70 ensure that the angled rear edge slides past the suction elements without collision. Owing to its proximity to the plate cylinder 1, the printing plate 9 is relatively rigid in the region of the lower row of suction elements 56, with the result that, for the passage of the angled printing-plate rear edge 41, a lever 57, in the form of a plate with hinge and carrying the entire row of suckers, or a plurality of levers 57 are swivelled into their positions shown in FIG. 10 by means of one or more cylinders 59, with the result that the printing-plate rear edge 41 is able properly to pass the row of suckers. Subsequently, the pressing-on roller 64 is moved radially towards the plate cylinder 1, as a result of which the angled printing-plate rear edge 41 is pressed into the rear-edge clamping device 40 of the plate cylinder 1. The rear-edge clamping device 40 closes and then tensions the printing plate through appropriate displacement in the circumferential direction of the plate cylinder 1. Thereafter, the carriage 54 is moved back to its original position in order, at the appropriate time, to grip the next printing plate 9.

The device moves back into its starting position in that the cylinders 59 are rendered pressureless, with the result that the springs 60 are able to ensure that the lever(s) 57 return to their original positions. Subsequently, the pressing-down device 62 comes into action, ensuring that the remaining printing plates 9 remain properly in the cassette 8 and are unable to tip out, particularly when the magazine 4 is swiveled back into its vertical position.

FIG. 10 shows that the upper and middle rows of suction elements 56 are associated with elastic brackets 70. The elasticity of the brackets 70 permits the suction-gripping of the printing plate 9 that is to be used; that is, the brackets 70 do not disrupt this operation. As soon as the suction elements 56 no longer have any vacuum and, to that extent, the printing-plate rear edge 41 slides past the suction elements 56 during the supplying of the printing plate 9, the brackets 70 ensure that the angled printing-plate rear edge 41 does not catch on the suckers of the suction elements 56.

What is claimed is:

1. Device, in the form of a magazine having a given length, for removing printing plates from a plate cylinder of a printing press, in particular for the automatic changing of printing plates, comprising a plate-removing apparatus, said apparatus comprising activatable holding means for holding the respective printing plate, said holding means being disposed on a carriage, said carriage being adapted to be moved along a guide substantially over the whole length of the device, inside the magazine.

2. The device according to claim 1, wherein said holding means are in the form of activatable suction elements.

3. The device according to claim 1, further comprising a driving apparatus, and wherein said carriage is adapted to be moved by means of said driving apparatus, said driving apparatus comprising a magnetic coupling.

4. The device according to claim 3, wherein said driving apparatus comprises a non-ferromagnetic tube, said tube extending along a motion path of said carriage and being longitudinally displaceably surrounded by a ferromagnetic component attached to said carriage, and a magnetic piston, longitudinally movable by a pressure medium, disposed in said tube, said piston forming said magnetic coupling together with said ferromagnetic component.

5. The device according to claim 1, wherein said guide is formed of two spaced-apart guide members.

6. The device according to claim 5, further comprising a driving apparatus for driving said carriage, and wherein one of said guide members is formed by said driving apparatus.

7. The device according to claim 1, wherein said holding means is a plurality of holding means, and at least one of said holding means is movably held on said first carriage transversely with respect to a plane of the printing plates.

8. The device according to claim 7, further comprising a forced-control device, and a cassette for receiving the printing plates disposed in said magazine, and wherein, with said carriage in an upper position, said movably held holding means is adapted to be moved, by means of said forced-control device, towards the plane of the printing plates in such a manner that, on insertion into said cassette, an angled trailing edge of the printing-plate comes under a holding edge of said cassette.

9. The device according to claim 8, wherein said forced-control device is formed by a bevelled section which is contacted by a sensing member for moving said movably held holding means.

10. The device according to claim 1, including actuatable hold-down means disposed in a lower region of said magazine for engaging used printing plates received in said magazine.

11. The device according to claim 1, including a guide roller disposed in a lower region of said magazine for introduction of the used printing plates into said magazine.

12. Device for removing printing plates from a plate cylinder of a printing press, comprising:

a magazine having an interior with a given length for receiving printing plates therein;

a carriage disposed in the interior of said magazine; holding means disposed on said carriage for holding the printing plates being received in said magazine; and a guide disposed in the interior of said magazine, said carriage with said holding means being adapted to be moved along said guide substantially over the entire given length.

13. The device according to claim 12, which further comprises a driving apparatus for driving said first carriage, said driving apparatus comprising a magnetic coupling.

14. The device according to claim 5, wherein said ferromagnetic component is a steel ring.

15. The device according to claim 5, wherein said guide members are guide rods.

16. The device according to claim 9, wherein said sensing member comprises rollers for swiveling said holding means.

* * * * *